US010221574B2

(12) United States Patent
Krause

(10) Patent No.: US 10,221,574 B2
(45) Date of Patent: Mar. 5, 2019

(54) INSULTING STRUCTURE FOR BUILDINGS

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

(21) Appl. No.: 15/610,531

(22) Filed: May 31, 2017

(65) Prior Publication Data

US 2017/0342723 A1 Nov. 30, 2017

Related U.S. Application Data

(60) Provisional application No. 62/343,284, filed on May 31, 2016.

(51) Int. Cl.

| | |
|---|---|
| ***E04F 13/08*** | (2006.01) |
| ***E04B 1/41*** | (2006.01) |
| ***E04B 1/76*** | (2006.01) |
| *E04B 1/38* | (2006.01) |

(52) U.S. Cl.

CPC ..... *E04F 13/0821* (2013.01); *E04B 1/40* (2013.01); *E04B 1/7629* (2013.01); *E04B 1/7654* (2013.01); *E04F 13/0846* (2013.01); *E04B 2001/405* (2013.01); *E04F 13/0878* (2013.01)

(58) Field of Classification Search

CPC ..... E04F 13/0821; E04F 13/0846; E04F 13/0878; E04B 1/7629; E04B 1/7654; E04B 1/40; E04B 2001/405

USPC .. 52/235, 474, 489.1, 483.1, 506.06, 506.08

See application file for complete search history.

(56) References Cited

U.S. PATENT DOCUMENTS

| | | | | |
|---|---|---|---|---|
| 2,245,785 A | | 6/1941 | Jentzer, Jr. | |
| 2,607,447 A | * | 8/1952 | Tuttle | E04B 1/40 428/116 |
| 3,628,299 A | * | 12/1971 | Nakazawa | E04B 1/4107 52/506.06 |
| 4,044,521 A | | 8/1977 | Fischer et al. | |
| 4,151,697 A | | 5/1979 | Stilts | |
| 4,346,543 A | | 8/1982 | Wilson et al. | |
| 4,483,122 A | | 11/1984 | Crandell | |
| 4,581,868 A | * | 4/1986 | McCann | E04B 2/92 428/34 |
| 4,691,491 A | | 9/1987 | Lilley et al. | |

(Continued)

FOREIGN PATENT DOCUMENTS

| | | |
|---|---|---|
| EP | 2354368 A2 | 8/2011 |
| GB | 2188658 A | 10/1987 |

(Continued)

*Primary Examiner* — Brent W Herring

(74) *Attorney, Agent, or Firm* — The Watson IP Group, PLC; Jovan N. Jovanovic

(57) ABSTRACT

A coupling assembly for spacing outer sheeting or cladding away from a bracket member including a spacer. The spacer has a first end and a second end. The first end is in substantial overlying abutment with a bracket member and the second end is in substantial overlying abutment with an outer bracket member. A mineral wool is spaced between the bracket member and the outer bracket member, with the space providing the spacing therebetween. The space may be coupled to each of the outer bracket member and the bracket member with a fastener. An insulation system is also disclosed.

8 Claims, 3 Drawing Sheets

(56) References Cited

U.S. PATENT DOCUMENTS

| | | | | |
|---|---|---|---|---|
| 4,741,141 | A * | 5/1988 | Harke | E04F 13/0857 411/82 |
| 4,860,508 | A | 8/1989 | Jackson | |
| 4,920,719 | A | 5/1990 | Shaub et al. | |
| 5,022,211 | A | 6/1991 | Scott | |
| 5,444,945 | A | 8/1995 | Goodwin | |
| 5,544,461 | A | 8/1996 | Sommerstein | |
| 5,709,058 | A | 1/1998 | Shaw | |
| 5,715,634 | A | 2/1998 | Schultz | |
| 5,765,324 | A | 6/1998 | Schultz | |
| 5,799,461 | A | 9/1998 | Dittemore | |
| 5,848,512 | A | 12/1998 | Conn | |
| 5,860,257 | A | 1/1999 | Gerhaher et al. | |
| 5,901,518 | A | 5/1999 | Harkins | |
| 5,930,968 | A | 8/1999 | Pullam | |
| 6,029,418 | A | 2/2000 | Wright et al. | |
| 6,055,787 | A | 5/2000 | Gerhaher et al. | |
| 6,098,364 | A | 8/2000 | Liu | |
| 6,170,214 | B1 | 1/2001 | Treister et al. | |
| 6,205,731 | B1 | 3/2001 | Gerhaher | |
| 6,289,646 | B1 | 9/2001 | Watanabe | |
| 6,327,828 | B1 | 12/2001 | Carroll | |
| 6,357,193 | B1 | 3/2002 | Morris | |
| 6,367,219 | B1 | 4/2002 | Quinlan | |
| 6,393,796 | B1 | 5/2002 | Goettl et al. | |
| 6,401,412 | B1 | 6/2002 | Cooper | |
| 6,425,218 | B1 | 7/2002 | Doyon et al. | |
| 6,718,719 | B1 | 4/2004 | Hagerty | |
| 6,857,238 | B2 | 2/2005 | Alderman | |
| 6,910,311 | B2 | 6/2005 | Lindberg et al. | |
| 6,945,414 | B1 | 9/2005 | Stevens et al. | |
| 7,017,317 | B2 | 3/2006 | Capozzo | |
| 7,043,884 | B2 | 5/2006 | Moreno | |
| 7,174,686 | B1 | 2/2007 | Legband | |
| 7,404,273 | B2 | 7/2008 | Burg et al. | |
| 7,726,083 | B2 | 6/2010 | Wagner | |
| 7,849,651 | B2 | 12/2010 | Fujito et al. | |
| 7,891,146 | B1 | 2/2011 | Sherwin | |
| 8,127,507 | B1 | 3/2012 | Bilge | |
| 8,186,119 | B1 | 5/2012 | Huff et al. | |
| 8,464,487 | B2 | 6/2013 | Kenda et al. | |
| 9,249,579 | B2 * | 2/2016 | Dickey | E04F 13/007 |
| 9,499,974 | B2 * | 11/2016 | Bombino | E04B 1/7612 |
| 9,567,752 | B2 * | 2/2017 | McCandless | E04F 13/0807 |
| 9,777,486 | B1 * | 10/2017 | Simonsen | E04F 13/0801 |
| 9,783,992 | B2 * | 10/2017 | Bombino | E04B 1/7612 |
| 2001/0011443 | A1 | 8/2001 | Watanabe et al. | |
| 2003/0172606 | A1 | 9/2003 | Anderson | |
| 2004/0049999 | A1 | 3/2004 | Krieger | |
| 2005/0011154 | A1 | 1/2005 | Kim | |
| 2007/0022682 | A1 * | 2/2007 | Morgenegg | E04B 2/90 52/235 |
| 2007/0220821 | A1 | 9/2007 | Omiya | |
| 2008/0010922 | A1 | 1/2008 | Wagner | |
| 2008/0104918 | A1 | 5/2008 | Gleeson et al. | |
| 2008/0178538 | A1 | 7/2008 | Green et al. | |
| 2008/0263984 | A1 * | 10/2008 | Gillis | B25B 13/48 52/483.1 |
| 2009/0165410 | A1 | 7/2009 | Wuts | |
| 2010/0192495 | A1 | 8/2010 | Huff et al. | |
| 2012/0137609 | A1 | 6/2012 | Loyd | |
| 2013/0074432 | A1 | 3/2013 | Ciuperca | |
| 2013/0152498 | A1 | 6/2013 | Krause | |
| 2013/0174506 | A1 * | 7/2013 | Bombino | E04B 1/7612 52/309.13 |
| 2015/0096251 | A1 * | 4/2015 | McCandless | E04F 13/0807 52/404.3 |
| 2015/0121787 | A1 | 5/2015 | Krause | |
| 2017/0051512 | A1 * | 2/2017 | Bombino | E04B 1/7612 |

FOREIGN PATENT DOCUMENTS

| | | | |
|---|---|---|---|
| JP | 2002339473 | A | 11/2002 |
| RU | 2229573 | C2 | 5/2004 |
| RU | 51060 | U1 | 1/2006 |
| WO | 2009094894 | A1 | 8/2009 |
| WO | 2009127032 | A1 | 10/2009 |
| WO | 2010057273 | A1 | 5/2010 |
| WO | 2015038727 | A1 | 3/2015 |

* cited by examiner

INSULTING STRUCTURE FOR BUILDINGS

CROSS-REFERENCE TO RELATED APPLICATION

This application claims priority from U.S. Pat. App. Ser. No. 62/343,284 filed May 31, 2016, entitled "Insulating Structure For Buildings," the entire specification of which is hereby incorporated by reference in its entirety.

BACKGROUND OF THE DISCLOSURE

1. Field of the Disclosure

The disclosure relates in general to building products, and more particularly, to a bracket and insulation system, along with a coupling assembly, for use and positioning on a building substrate (i.e., a base structure).

2. Background Art

The use of insulation for buildings is known. Typically, a building structure has an inner structure and an outer structure (typically a cladding or sheeting). Between these structures space is provided through the use if bracket members (typically referred to as girts). Insulation is placed within the space provided by the bracket members. Unfortunately, these bracket members are typically formed of a metal material, and with the use of metal fasteners and the like, a highly thermally conductive path is devised from the outside of the building to the inside of the building.

In addition, many of the materials utilized for the outer sheeting can be highly flammable. Often, it is difficult to pass strict fire requirements with many different outside sheeting materials. High pressure laminate is one of such materials. Moreover, where insulative members are utilized for the girt members, the challenges are further amplified.

SUMMARY OF THE DISCLOSURE

The disclosure is directed to a coupling assembly for spacing outer sheeting or cladding away from a bracket member including a spacer. The spacer has a first end and a second end. The first end is in substantial overlying abutment with a bracket member and the second end is in substantial overlying abutment with an outer bracket member. A mineral wool is spaced between the bracket member and the outer bracket member, with the space providing the spacing therebetween. The space may be coupled to each of the outer bracket member and the bracket member with a fastener.

An insulation system is also disclosed. The insulation system includes a bracket member, an insulating member, an outer bracket member and a coupling assembly. The bracket member is coupled to a base structure. The insulating member is associated with the bracket member and overlying the base structure. The outer bracket member overlies the insulating member. The coupling assembly attaches the outer bracket member to the bracket member, and providing spacing for the insulating member therebetween.

In another aspect of the disclosure, the disclosure is directed to a combination of a coupling assembly and outer bracket for spacing outer sheeting or cladding away from a bracket member. The outer bracket member comprises a girt coupling flange and an outer panel flange spaced apart from each other. A spacing portion extends between the girt coupling flange and the outer panel flange. The girt coupling flange has at least one opening extending therethrough defining a cross-sectional configuration. The coupling member includes a spacer extendable through the at least one opening of the outer bracket member, a plug member corresponding to the cross-sectional configuration of the at least one opening, and a washer positionable over the at least one opening of the outer bracket. A fastener is structurally configured to be directed through the washer, the plug member and through the spacer into a base structure, to, in turn, couple the outer bracket to the base structure wherein the outer bracket is spaced apart from the substrate by the spacer.

In some configurations, the girt coupling flange and the outer panel flange are substantially parallel to each other and offset relative to each other.

In some configurations, the spacing portion is substantially perpendicular to the outer panel flange and the girt coupling flange.

In some configurations, the at least one opening comprises a plurality of openings extending through the outer bracket member.

In some configurations, the plurality of openings each have a substantially identical cross-sectional configuration.

In some configurations, the at least one opening comprises a tubular configuration with a plurality of axially extending flanges that are spaced apart from each other to define a star-like configuration.

In some configurations, the spacer has a cross-sectional configuration comprising a tubular configuration with a plurality of axially extending flanges that are spaced apart from each other to define a star-like configuration.

In some configurations, the plug member has a cross-sectional configuration comprising a tubular configuration with a plurality of axially extending flanges that are spaced apart from each other to define a star-like configuration.

In another aspect of the disclosure, the disclosure is directed to an insulation system that includes a bracket member, an insulating member, an outer bracket member, and a coupling assembly. The bracket member is coupled to a base structure. The insulating member is associated with the bracket member and overlies the base structure. The outer bracket member overlies the insulating member. The coupling assembly attaches the outer bracket member to the bracket member, and provides spacing for the insulating member therebetween. The structure is structurally configured to have an outer laminate sheeting coupled thereto.

In some configurations, the insulating member overlies the base structure with a portion of the bracket member extending into the insulating member so that a portion of the insulating member is disposed between the outer bracket member and the bracket member.

In some configurations, the outer bracket member is structurally configured to maintain the outer laminate sheeting and the insulating member in a spaced apart configuration.

In some configurations, the coupling assembly further comprises a spacer disposed through the insulating member to span between the bracket member and the outer bracket member.

In some configurations, the outer bracket member further includes an opening with the spacer extendable through the opening of the outer bracket member.

In some configurations, the coupling assembly further includes a plug member structurally configured to engage the opening of the outer bracket member. A washer is positionable on an outer surface of the outer bracket member so as to overlie the opening.

In some configurations, the spacer comprises a tubular configuration with a plurality of axially extending flanges that are spaced apart from each other to define a star-like configuration.

In another aspect of the disclosure, the disclosure is directed to a method of installing an insulating system over a base structure. The method comprises the steps of: providing a plurality of bracket members; coupling the plurality of bracket members to the base structure; providing an insulting member; positioning the insulating member over the base structure between bracket members, the insulating member overlying a portion of the base structure; providing an outer bracket member; positioning the outer bracket member over the insulating member and spanning over a bracket member, with the insulting member positioned therebetween; providing a coupling member; and coupling the outer bracket member to the bracket members.

In some configurations, the step of coupling a coupling member further comprises the steps of: providing a spacer; and positioning the spacer through the insulating member and between the bracket member and the outer bracket member.

In some configurations, the step of coupling a coupling member further comprises the step of: providing a spacer, a plug member, a washer and a fastener; directing the spacer through an opening in the outer bracket member, through the insulating member to the bracket member; inserting the plug member into the opening in the outer bracket to, in turn, seal the opening; placing the washer to overlie the opening that has been sealed by the plug member; and directing a fastener through the washer, the plug member, the spacer and into the bracket member thereby fastening the outer bracket member to the bracket member.

In some configurations, the outer bracket member comprises a plurality of openings. A coupling assembly is associated with each of the openings to in turn attach the outer bracket member to a plurality of bracket members.

BRIEF DESCRIPTION OF THE DRAWINGS

The disclosure will now be described with reference to the drawings wherein.

DETAILED DESCRIPTION OF THE DISCLOSURE

Figure 1:
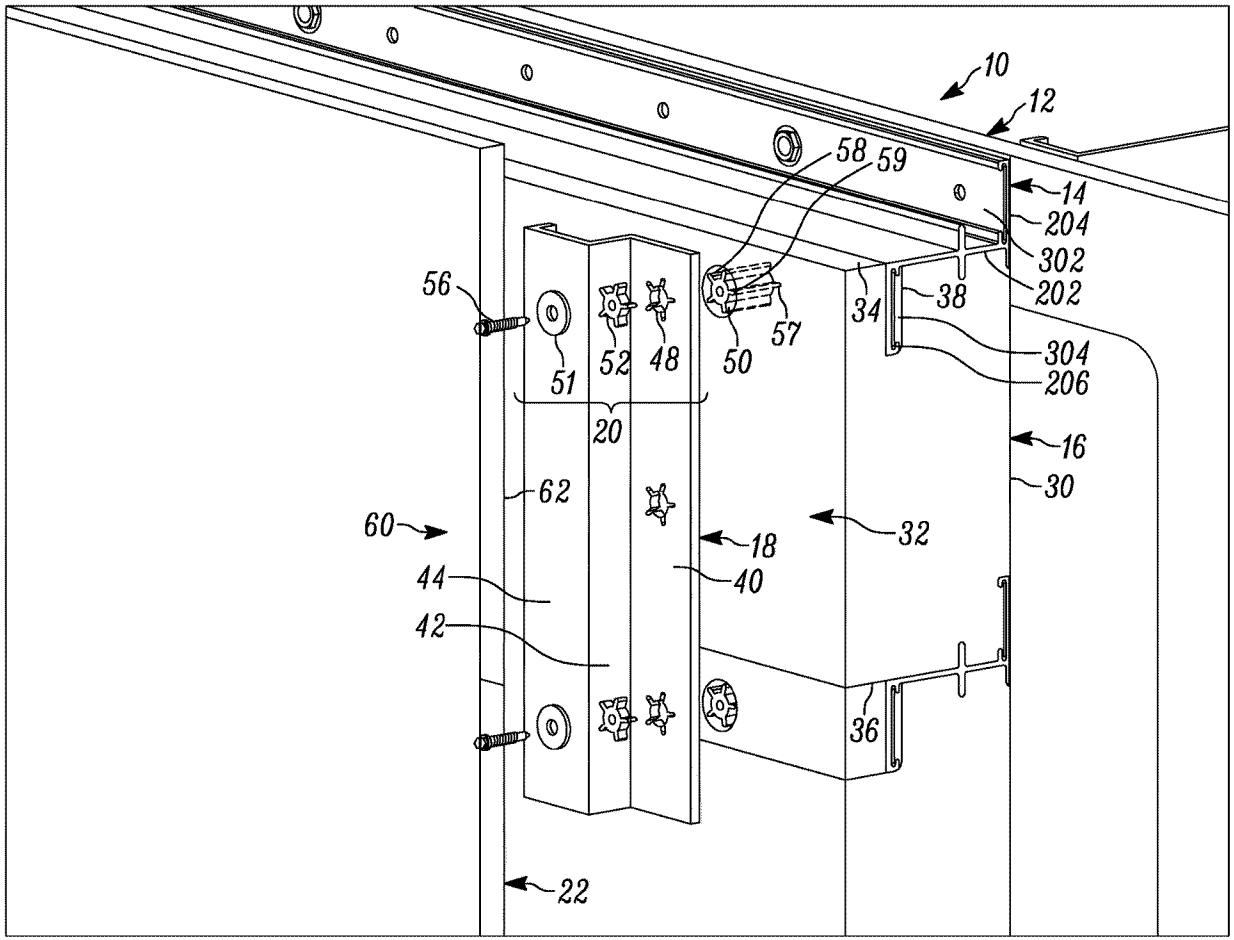
FIG. 1 of the drawings is an exemplary wall structure incorporating the insulating system of the present disclosure, and showing, in exploded, cut-away fashion, the underlying outer bracket member and the coupling assembly.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the insulating structure/system is shown generally at 10. The insulating system 10 includes base structure 12, bracket member 14, insulating member 16, outer bracket member 18, coupling member 20 and outer laminate sheeting 22. The structure is well suited for the use in association with high pressure laminate, although it is not limited thereto. Additionally, it will be understood that other materials are contemplated, as well as other variations of the structures.

The base structure 12 includes a plurality of studs that are spaced apart from each other so as to form a frame. Onto that frame, a substrate is provided, such as, for example, sheet material such as plywood, particle board, among others. Of course, other structures are likewise contemplated, including other building substrates, including, but not limited to combinations of metal, wood, concrete and other materials from which walls can be formed. In other configurations, composite sheeting is utilized to span between the studs and/or other wall structures. The base structure includes an outer surface to which the bracket members are mounted.

The bracket member 14 comprises a polymer based (including fiber reinforced) bracket members and may include any one of the types disclosed in U.S. Pat. Nos. 8,826,620; 8,833,025; and 9,151,052 each of which are issued to Krause, all of which are hereby incorporated by reference in their entirety. The exemplary configuration shown is but one of the different configurations shown in the above-incorporated prior art patents, and the structure is not limited to the particular configuration shown.

It will be understood that the bracket member 14 includes a body wall 202, first end wall 204 and second end wall 206. The end walls 204 and 206 may include first and second end wall strips 302, 304 which are preferably slidably disposed in the end walls 204, 206.

Figure 2:
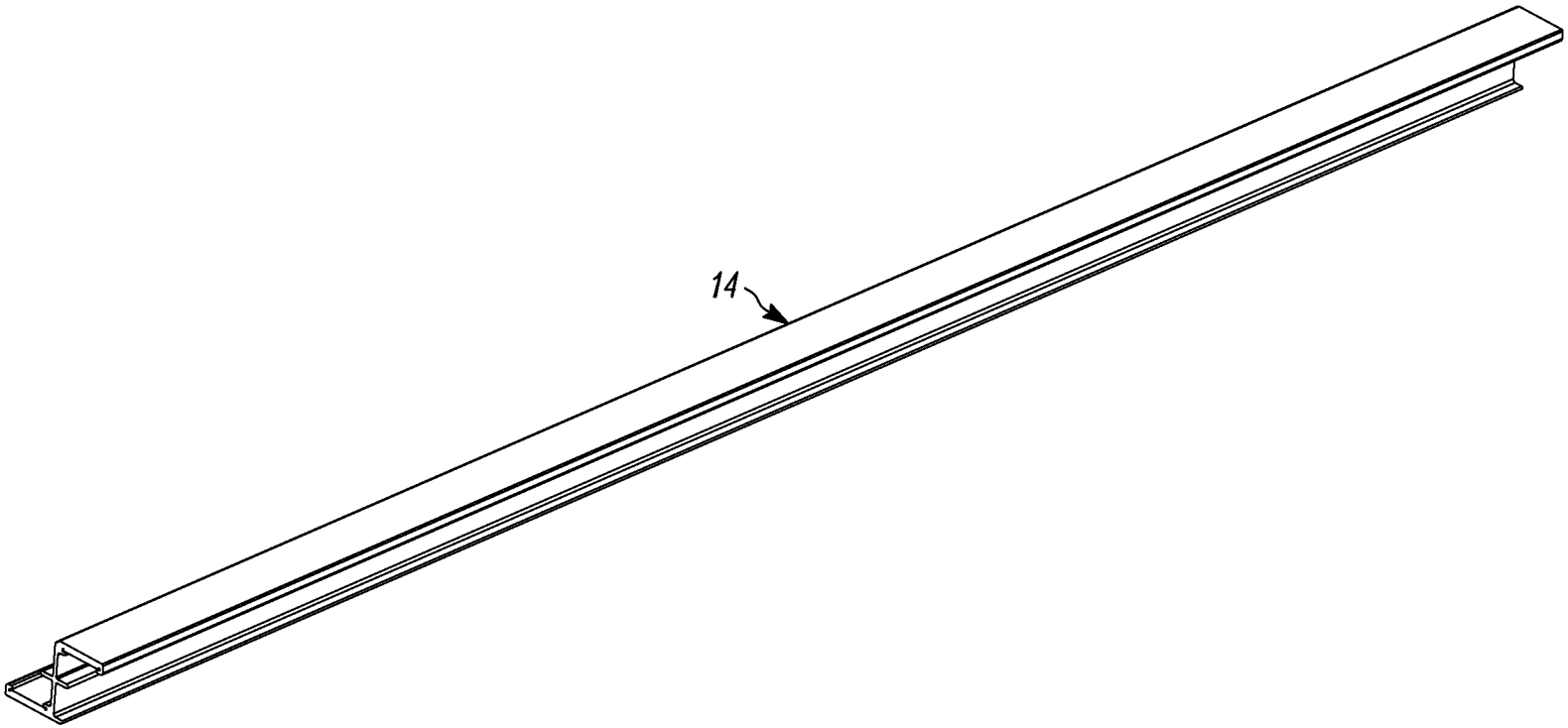
FIG. 2 of the drawings is a perspective view of an exemplary bracket member of the present disclosure.
Figure 3:
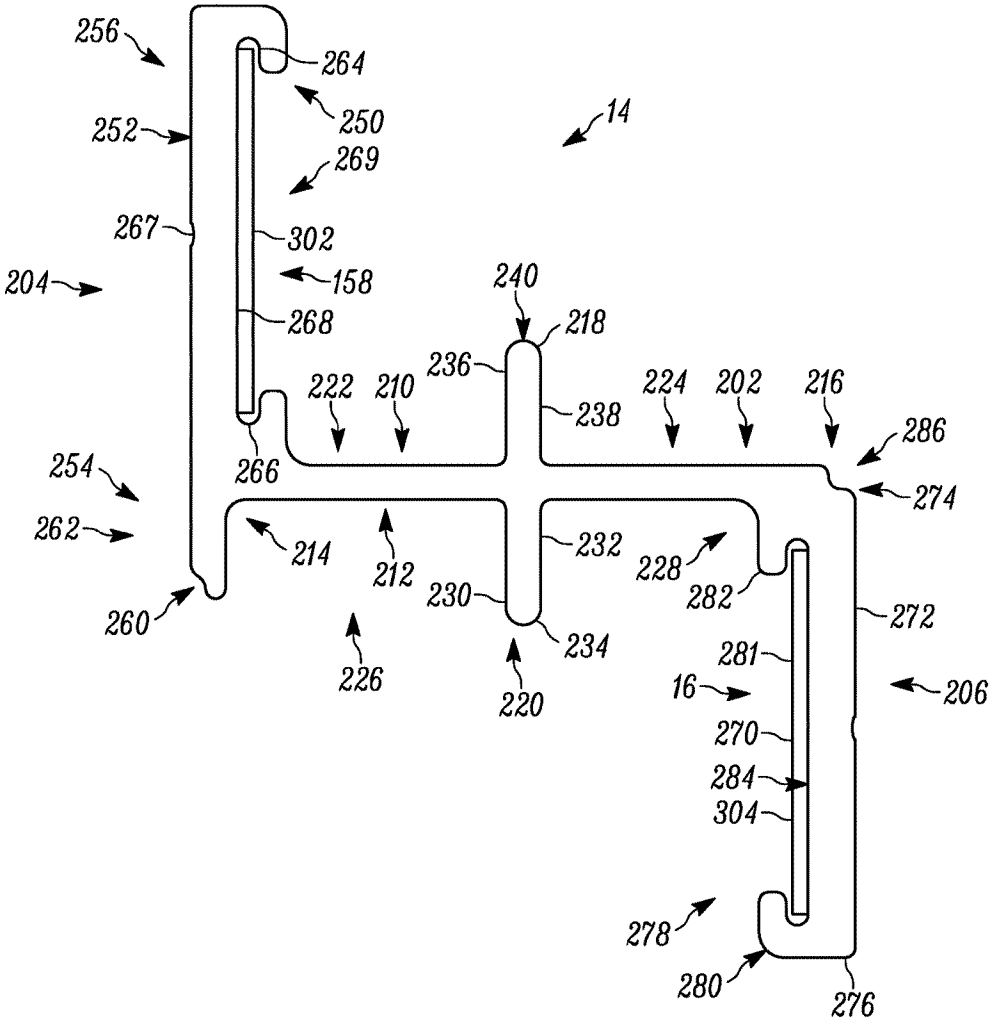
FIG. 3 of the drawings is a cross-sectional view of an exemplary bracket member of the present disclosure.

In greater detail, Bracket member 14 (also known in the industry as a "girt") is shown in FIGS. 2 and 3 as cooperating with the insert rigidity members 16. The bracket member itself comprises a polymer member, or a composite member that includes body wall 202, first end wall 204 and second end wall 206. In the embodiment shown, the first end wall 204 is generally perpendicular to the body wall 202 and the end wall 206 is likewise perpendicular to the body wall 202. It is contemplated that the bracket comprises an elongated member which is of a generally uniform cross-sectional shape, with variations that may be positioned along the length thereof.

Typically, such bracket members may be provided in any number of standard sizes that may be from only a couple of feet long to spans that are forty to fifty feet long. It is most preferred that the bracket members comprise a pultruded profile that includes both stranded members and woven members within a resin matrix. It will be understood that the shape can be formed through one or more pultrusion dies to achieve the final desired configuration. It is contemplated that a single resin system may be utilized, or that multiple resin systems may be utilized. Of course, the particular configuration and application may dictate changes to the relative thicknesses and dimensions of the different components. Among other fibers, it is contemplated that the fibers may comprise glass fibers (fiberglass), carbon fibers, cellulose fibers, nylon fibers, aramid fibers, and other such reinforcing fibers.

The bracket members provide a thermal break. As used herein, the term "thermal break" refers to a break in like materials wherein the material disposed between like materials is comprised of a material having low thermal conductivity such as a polymeric material having a high R-value as further described below. R-values are measurements of the thermal resistance of different materials. R-values are well known by those skilled in the art of the construction and insulation industries. A high R-value indicates a highly insulative material, such as an R-value of R.2 per inch and higher. Conductive materials have a very low R-value, such as steel which exhibits a negligible or nearly non-existent R-value. In the configuration of the present disclosure, there are no like materials in contact with one another, nor is there any metal to metal contact creating a pathway for heat to transfer from the exterior to the interior and vice versa.

It is also contemplated that the bracket members may comprise anticorrosive polymeric materials that exhibit high insulative qualities or rather, demonstrate high R-value properties such as an R-value in the range of about R.2 to about R8 per inch. Polymeric materials suitable for the present disclosure include thermoplastics or thermoset resin materials including for example: acrylonitrile-butadiene-styrene (ABS) copolymers, vinylesters epoxies, phenolic resins, polyvinyl chlorides (PVC), polyesters, polyurethanes, polyphenylsufone resin, polyarylsulfones, polyphthalimide, polyamides, aliphatic polyketones, acrylics, polyxylenes, polypropylenes, polycarbonates, polyphthalam ides, polystyrenes, polyphenylsulfones, polyethersulfones, polyfluorocarbons, bio-resins and blends thereof. Other such thermoplastics and thermoplastic resins suitable for the present disclosure are known in the art which demonstrate high R-values and are thereby heat resistant as well as anticorrosive. Thermoplastics of the present disclosure are also contemplated using a recyclable polymer or are made of a polymeric material which is partially comprised of a renewable resource such as vegetable oil or the like in its composition when an eco-friendly or "green" bracket member is desired. The polymeric material of the present disclosure can also be reinforced with a reinforcing fiber as detailed below. Bracket members composed of the materials discussed above form a thermal break between exterior panels and building substrates in an effort to control the temperature within a building structure by reducing or eliminating thermal conductivity from the exterior panel to the building substrate and vice versa. In assembly, the R-value of an exterior wall panel system of the present disclosure can typically exhibit a R-value from about R.2 to about R30 per inch depending on the thickness of the overall system, the insulation materials used and the composition of the bracket members. Further, microspheres, such as polymeric or glass nanospheres, can be added to the makeup of the brackets to provide further insulative properties and increased R-value expression.

There are several different types of measurements that relate to a materials ability to insulate, resist, transmit or conduct heat across a material. Particularly, a material's K-value relates to a specific material's thermal conductivity, a material's C-value correlates to the material's thermal conductance, a material's R-value relates to a material's thermal resistance, and a U-value relates to the thermal transmittance of an overall system. In designing a wall, roof or deck bracket and panel system providing adequate insulative properties for a building structure, materials with low K-values and C-values are desired while materials with high R-values are desired. When this set of conditions is met, the overall thermal transmittance, or U-value, of the system is low. Thus, the lower the U-value, the lower the rate heat thermally bridges from one material to another. A building structure having a well insulated system will have a much lower U-value than an uninsulated or poorly insulated system exhibiting high thermal transmittance.

Regarding the R-value of the bracket members of the present disclosure, a relatively high R-value is desired to ensure adequate insulation of a building structure from outside elements by making a bracket that creates a thermal break in a wall panel system. A range of R-values for the polymeric materials used to construct the bracket members described above would be a range of about R.2 to about R8 per inch in order to create a thermal break that effectively reduces or eliminates thermal bridging. The thermal conductivity, or K-value, is the reciprocal of the material's R-value, such that for a polymeric material exhibiting an R-value of about R.2 to R8 per inch, the correlating K-value for that material would be from about K5 to about K0.125 per inch. Thus, in comparison to present day metal brackets used in other bracket and panel systems made of iron or steel, a polymeric bracket member of the present disclosure will exhibit a K-value of approximately about K.5 to about K0.125 per inch at a given set of conditions as compared to a bracket made from a metallic material such as iron or steel which would have an approximate K-value as high as K32 to K60 per inch at the same conditions. This is because metallic materials, such as iron and steel, have low or negligible R-values and are well known conductors of heat. Steel is known to have an R-value of about 0.003R per inch. Thus, for example, a steel bracket compared to a polymeric bracket of the present disclosure having an R-value of R.55 would be 183 times more thermally conductive.

The body wall 202 includes top surface 210 and bottom surface 212 which extend from first end 214 to second end 216, upper rib 218 and lower rib 220. The upper rib extends outwardly from the top surface 210 between the first and second ends, bisecting the top surface into a top first end portion 222 and a top second end portion 224. The upper rib 218 preferably extends substantially perpendicularly to the top surface 210, and, includes first side 236, second side 238 and tip region 240 spanning therebetween. The first side 236 and the second side 238 are generally parallel to each other for at least a portion of the length. The size of the upper rib 218 is that it substantially matches that of the longitudinal slots 120 of the insulation panel 12, while being slightly oversized in a number of the dimensions, if not in virtually all dimensions or all dimensions. That is, preferably, the upper rib 218 has the same shape as the longitudinal slots 120 except that it is larger dimensionally than the longitudinal slots by an amount that allows for at least elastic deformation of the longitudinal slot 120 upon insertion of the upper rib 218 therein.

The lower rib 220 preferably extends substantially perpendicularly to the bottom surface 212 of the body wall 202, and, includes first side 230, second side 232 and tip region 234. The lower rib 220 is preferably positioned on the opposite side of the upper rib 218, and has the same dimensions as the upper rib. As with the upper rib, the lower rib bisects the bottom surface 212 into a bottom first end portion 226 and a bottom second end portion 228. It will be understood that the shapes of the upper and lower rib may be varied, but where the longitudinal slots 120 are substantially uniform, the upper and lower rib are each configured to facilitate at least elastic deformation of the longitudinal slot 120 upon insertion of the upper or lower rib thereinto. It is this intimate engagement along the length thereof through the elastic deformation that provides for the sealing and, in turn, the vapor barrier on opposing sides of the rib.

The first end wall 204 is positioned at the first end of the body wall 202 and, as set forth above, is preferably perpendicular to the body wall 202. In the embodiment shown, the first end wall extends downwardly from the bottom surface 212, and projects downwardly beyond the bottom surface 212 to define a lower flange portion 262. In certain embodiments, it is helpful to line an inside surface of the lower flange portion 262 with an adhesive or sealant (such as butyl rubber). The first end wall 204 includes inside surface 250, outside surface 252, and extends from lower end 254 to upper end 256. The upper end 256 includes lower flange portion 262. It is contemplated that the lower flange portion 262 extends upwardly a distance sufficient to provide an effective surface for the application and retention of an adhesive or sealant.

The lower flange portion 262 at a lower end on the outside surface 252 thereof includes a capillary break 260 (in the form of a relief portion which tapers toward the upper edge). As set forth in the incorporated references, the capillary breaks the water tension between it and the cladding or building substrate with which it is in contact so as to act as anti-capillary action grooves for water trapped therebetween or drawn into the joints.

A first reinforcement channel 258 is defined on one of the inside surface and the outside surface of the first end wall, and preferably on the inside surface thereof. The first reinforcement channel 258 includes upper clip portion 264 and lower clip portion 266 spanned on one side by surface 268 and open to the other side defining slot 269. The channel is generally parallel to the outside surface 252 and generally extends the entirety of the inside surface 250 below the bottom surface 212 of the body wall 202.

As will be explained below, first end wall strip 302 is slidably introduced into the first reinforcement channel 258. In certain embodiments, the first end wall strip 302 is relatively snug within the first reinforcement channel 258. Preferably, the first end wall strip 302 comprises a metal member, such as an aluminum, magnesium, steel, galvanized steel or another material. Of course, it is contemplated that the first end wall strip 302 comprises a composite member of a configuration that is the same or different than that of the bracket member. It is preferred that the first end wall strip 302 comprises a member of ductility sufficient so as to receive and be pierced by a fastener or the like, while retaining the fastener therein.

It will further be understood that a guide notch 267 extends on the outside surface 252 and along the length thereof. The guide notch 267 is provided so as to provide a user with a tactile feel for where to begin the insertion of a fastener. By initiating a fastener at the guide notch, it is such that the fastener will be directed into contact at an appropriate portion of the first end wall strip 302 positioned within the first reinforcement channel 258.

The second end wall 206 as shown in FIG. 7 is positioned at the second end of the body wall 202, and is preferably perpendicular to the body wall 202 (and parallel to the first end wall 204). In the embodiment shown, the second end wall extends downwardly from the bottom surface 212 of the body wall 202.

The second end wall includes inside surface 270 and outside surface 272 which extend from inner end 274 (which is at the junction with the body wall 202), to outer end 276. A capillary break 286 having a configuration that matches the capillary break 260 of the first end wall 204.

A second reinforcement channel 278 is defined in one of the inside surface and the outside surface of the second end wall, and preferably on the inside surface thereof. The second reinforcement channel includes outer clip portion 280 and inner clip portion 282 which are spanned on one side by surface 284 and which define slot 281 on the other side thereof. The channel is generally parallel to the outside surface 272 of the second end wall, and generally extends the entirety of the inside surface below the lower surface 212 of the body wall 202.

As with the first end wall 204 above, second end wall strip 304 is slidably introduced into the second reinforcement channel 278, preferably, relatively snug therewithin. Preferably, the same materials are utilized for the second end wall strip 304 as with the first end wall strip 302.

In other configurations, the reinforcing strips can be coupled to the body in other manner, such as, for example being adhered to the body, or being coupled to the body through fasteners or the like. In other configurations, the reinforcing channels can be omitted and the reinforcing strips can be applied directly to and coupled directly to the body. In still other configurations, the first and second strips may be formed from a material other than a metal member, such as, a polymer member, a reinforced member or members that are composites that include metal components. The insulating member 16 is shown as comprising a sheeting-like material which including inner surface 30, outer surface 32, top end wall 34 and bottom end wall 36. The insulating member 16 is preferably a mineral wool member that is of the desired dimensional configuration so that with the thickness of the top end wall and the bottom end wall is greater than the width of the body wall. In such a configuration, a slit 38 can be provided in the insulating member so as to facilitate the placement of the end wall thereinto. It will be understood that the thickness and the composition of the insulating member may be varied, depending on the particular application thereof and the particular location of the installation, as well as other parameters. While other materials are contemplated, typically, a fiber based material such as mineral wool, or glass fibers are preferred.

The outer bracket member 18 comprises a secondary bracket member that is preferably positionable in an orthogonal configuration relative to the bracket member. In the configuration shown, the secondary bracket member is installed generally vertically, as the underlying bracket members are substantially horizontal. In the configuration shown, the outer bracket member 18 comprises a metal member, such as steel, aluminum or an alloy thereof, among other metal materials. The length of the outer bracket member can be varied. In some configurations, a number of relatively short outer bracket members may be utilized, such as outer bracket members being several inches to a few feet long. Whereas, in other configurations, the outer bracket member may be in excess of 10 to 20 feet long, or longer. The disclosure is not limited to any particular length of the outer bracket member, and a number of different lengths are contemplated.

The outer bracket member 18 includes girt coupling flange 40, spacing portion 42 and outer panel flange 44. The spacing portion 42 separates the relative position of the girt coupling flange 40 and the outer panel flange 44. In the configuration shown, the girt coupling flange and the outer panel flange are substantially parallel to each other in spaced apart planes, which spacing is achieved through the spacing portion 42. It will further be understood that an additional rib may extend from a distal portion of the outer panel flange (or the girt coupling flange) to provide enhanced rigidity to the outer bracket member. The thickness of the flange is largely determined by the spacing portion 42. Additionally, it will be understood that, preferably, the girt coupling flange and the outer panel flange from opposite sides of the spacing portion. The outer bracket member may span only one bracket member 14, or may span across multiple bracket members and connected to any one or more of the bracket members across which the outer bracket member spans. It will be understood that while a particular cross-section of the outer bracket member is shown, it will be understood that other configurations are contemplated as well, including, but not limited to, for example, members having a square or rectangular cross-sectional configuration, to structures having offset leg members or flat members that are joined together through a connecting web. The flat members may define planes that are parallel to each other with a connecting web being perpendicular thereto, or oblique thereto. The disclosure is not limited to any particular configuration of the outer bracket member, and advantageously, the bracket member provides a spacing between the insulation (and the bracket member 14) and the outer laminate sheeting 22.

The outer bracket member may further include openings, such as openings 48 which are disposed along the girt coupling flange 40. The openings 48 may be shaped so as to correspond to the spacer 50 of the coupling assembly.

The coupling assembly 20 is shown as comprising spacer 50, plug member 52, washer 54 and fastener 56. The spacer 50 includes first end 57, second end 58 and cross-sectional configuration 59. In the configuration shown, the spacer 50 has a substantially uniform cross-sectional configuration that is tubular with axially extending flanges that are spaced apart from each other to define a star-like configuration. In other configurations, a tubular member may be provided, which may or may not have other shapes extending therefrom or there around. Advantageously, the configuration shown is able to cut through the mineral wool during installation (as will be explained). In still other configurations, the elongated member may comprise a different cross-sectional shape, such as, for example, a cross, a alphabetical letter, an arbitrary shape or the like. Advantageously, although not required, the structure disclosed provides an ability to be directed through the mineral wool. In other configurations, it will be understood that openings may be provided in the insulating member for passage of the coupling member. It will be understood that the spacer member has a substantially uniform cross-sectional configuration so as to be structurally configured to be formed through an extrusion process or the like.

The plug member 52 has a similar configuration as the spacer member (and the opening of the girt coupling flange), with a preferably smaller opening through which the fastener extends. The washer 54 is sized so as to be larger than the opening and shaped so that it remains on the outer surface of the girt coupling flange, and so that it does not extend through the opening. Additionally, the washer has a central opening for the fastener, which precludes the head of the fastener from extending therethrough. The fastener preferably comprises a screw with a head and a shaft that is threaded. It is contemplated that the components of the coupling member comprise a metal material, while it is contemplated that the components of the spacer, plug member and the washer may comprise other materials capable of relatively high temperatures while maintaining integrity and the like. It is contemplated that the washer and the plug member may be integrally formed as a single structure. In other configurations, it is contemplated that the fastener may be integrated with one or both of the spacer and the plug member. It will be understood that while these may be referenced separately, the structures may be integrally formed.

The outer laminate sheeting 22 includes an outer surface 60 and an inner surface 62. In the configuration shown, the outer laminate sheeting 22 comprises a high pressure laminate. Such high pressure laminates, while very decorative and the like, are typically difficult to incorporate in building structures due to the flammability of the same. It will be understood that while such a configuration is shown, other outer sheeting is likewise contemplated for use, including but not limited to metal sheeting, fiberboard, composite structures and the like, among others.

In an assembled configuration, as shown, the underlying base structure 12 is provided. In the configuration shown, the base structure 12 includes metal stud members that are aligned vertically. The metal stud members are spaced apart from each other a predetermined distance (i.e., 16" on center, for example). Sheathing and water resistant barrier material may be positioned on the metal stud members and attached together through fasteners and the like.

The bracket members 14 are positioned along the substrate and coupled to the metal stud members by extending fasteners through the first end wall 204. In the configuration shown, the bracket members 14 can be positioned so as to be substantially perpendicular to the metal stud members. They can be positioned in a spaced apart orientation along the wall, such that they are all parallel to each other. The spacing between the different bracket members 14 may depend on a number of factors, including, but not limited to, climate, materials, building type, design parameters, etc. The particular spacing shown is to be deemed exemplary, and not to be deemed limiting.

The insulating member 16 is coupled to the bracket members and captured between the bracket members by the structures on the bracket member 14. In the configuration shown, a slit 38 is provided in the insulating member (at the top end wall, or a bottom end wall, depending on the configuration, or both). The second end wall 206 is extended into the slit. In such a configuration, the insulating member overlies the outer surface of the second end wall 206 of the bracket member 14. With this structure, in accompaniment with other structures on the bracket member, the insulating member and the bracket member are mechanically coupled to each other. As noted above, preferably, in the configuration show, the insulating member comprises a mineral wool.

The outer bracket member is positioned so as to overlie the mineral wool and to straddle between the different bracket members. In the configuration shown, the outer bracket member is oriented substantially vertically and configured to span between multiple bracket members in an overlying fashion over both the bracket member and the insulting member. In the configuration shown, the outer bracket member is mounted perpendicular to the bracket member and with the girt coupling flange in overlying position relative to the insulating member.

To couple the outer bracket member to the bracket member through the insulating member, the coupling assembly is provided. The fastener 56 is extended through the washer, plug member and spacer. The spacer with fastener is pushed through the opening 48 and through the insulating member into substantial overlying abutment with the bracket member, and in particular, the end wall 206 thereof. The second end remains in contact with the inside of girt coupling flange 40 (i.e., in substantial overlying abutment with the girt coupling flange). The plug member 52 plugs the opening in the girt coupling flange so that the spacer does not realign with the opening and extend back through the opening. The washer maintains the fastener head on the opposite side of the opening, and precludes the fastener head from exiting through the opening. In addition, the washer maintains the plug member in the proper orientation.

As the fattener 56 is threaded into the end wall of the bracket member 14, the spacer defines the spacing between the bracket member and the outer bracket member. Additionally, as the bracket member is within the slit in the insulating member, the spacer maintains the desired space for the insulating member to extend between the outer bracket member and the bracket member. Such spacing provides additional insulation to the bracket member in the event of a fire that consumes the outer laminate sheeting.

The outer laminate sheeting is placed over the outer bracket member and is fastened to the outer bracket member. It will be understood that the outer laminate sheeting is isolated thermally from the base structure. That is, the outer laminate sheeting is fastened to the outer bracket member, which is then fastened to the bracket member, which comprises an insulative member, the other end of which is fastened to the base structure. Thus, thermal isolation is achieved. Moreover, insulation is positioned between the outer bracket member and the bracket member through the space provided by the spacer 50.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A combination of a coupling assembly and outer bracket for spacing outer sheeting or cladding away from a bracket member, the outer bracket member comprising: a girt coupling flange and an outer panel flange spaced apart from each other, with a spacing portion extending between the girt coupling flange and the outer panel flange, the girt coupling flange having at least one opening extending therethrough defining a cross-sectional configuration;

the coupling assembly comprising: a spacer extendable through the at least one opening of the outer bracket member, a plug member corresponding to the cross-sectional configuration of the at least one opening, and a washer positionable over the at least one opening of the outer bracket, wherein a fastener is structurally configured to be directed through the washer, the plug member and through the spacer into a base structure, to, in turn, couple the outer bracket to the base structure wherein the outer bracket is spaced apart from a substrate by the spacer.

2. The combination of claim 1 wherein the girt coupling flange and the outer panel flange are substantially parallel to each other and offset relative to each other.

3. The combination of claim 2 wherein the spacing portion is substantially perpendicular to the outer panel flange and the girt coupling flange.

4. The combination of claim 1 wherein the at least one opening comprises a plurality of openings extending through the outer bracket member.

5. The combination of claim 4 wherein the plurality of openings each have a substantially identical cross-sectional configuration.

6. The combination of claim 1 wherein the at least one opening comprises a tubular configuration with a plurality of axially extending flanges that are spaced apart from each other to define a star-like configuration.

7. The combination of claim 6 wherein the spacer has a cross-sectional configuration comprising a tubular configuration with a plurality of axially extending flanges that are spaced apart from each other to define a star-like configuration.

8. The combination of claim 7 wherein the plug member has a cross-sectional configuration comprising a tubular configuration with a plurality of axially extending flanges that are spaced apart from each other to define a star-like configuration.

* * * * *